US009134689B2

(12) United States Patent
Katamoto

(10) Patent No.: US 9,134,689 B2
(45) Date of Patent: Sep. 15, 2015

(54) IMAGE FORMING DEVICE HAVING ELECTRICAL COMPONENTS

(71) Applicant: KYOCERA Document Solutions Inc., Osaka (JP)

(72) Inventor: Toru Katamoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/313,555

(22) Filed: Jun. 24, 2014

(65) Prior Publication Data

US 2015/0003857 A1 Jan. 1, 2015

(30) Foreign Application Priority Data

Jun. 28, 2013 (JP) ..... 2013-136590

(51) Int. Cl.
*G03G 15/00* (2006.01)
*G03G 21/16* (2006.01)

(52) U.S. Cl.
CPC ..... *G03G 21/1652* (2013.01); *G03G 21/1604* (2013.01)

(58) Field of Classification Search
CPC ..... G03G 15/80; G03G 21/1652; G03G 21/1604; G03G 21/1609; G03G 21/166
See application file for complete search history.

(56) References Cited

U.S. PATENT DOCUMENTS 5,918,089 A * 6/1999 Malinich et al. ..... 399/90
6,853,819 B2 * 2/2005 Sugita ..... 399/90

FOREIGN PATENT DOCUMENTS

JP 2004219663 A * 8/2004 ..... G03G 21/16
JP 2006-259778 A 9/2006

* cited by examiner

*Primary Examiner* — Clayton E Laballe
*Assistant Examiner* — Victor Verbitsky
(74) *Attorney, Agent, or Firm* — Stein IP, LLC

(57) ABSTRACT

This image forming device has a first electrical component and a second electrical component, arranged in positions offset such that there is no mutual overlap; a third electrical component swivelably supported about pivots as pivot points; and support members for pivotably supporting the pivots. The support members pivotably support the pivots between the first electrical component and the second electrical component. The third electrical component, through swiveling, is selectively positioned at a first location overlapping the first electrical component but not overlapping the second electrical component, or at a second location overlapping the second electrical component but not overlapping the first electrical component.

6 Claims, 11 Drawing Sheets

IMAGE FORMING DEVICE HAVING ELECTRICAL COMPONENTS

CROSS-REFERENCE TO RELATED APPLICATIONS

This application is based upon and claims the benefit of priority from the corresponding Japanese Patent Application No. 2013-136590, filed Jun. 28, 2013, the entire contents of which are incorporated herein by reference.

BACKGROUND OF THE INVENTION

The present disclosure relates to an image forming device provided with electrical components such as an electronic circuit board or the like.

Multiple different electrical components, such as electronic circuit boards or the like, are installed in image forming devices. In the event that a malfunction or the like has occurred in these electrical components, maintenance must be performed by service personnel. For example, in the past, multiple different electrical components were installed at the back face side of the device chassis, permitting maintenance to be performed from the rear of the device chassis.

For example, with a view to making image forming devices more compact, multiple different electrical components are sometimes positioned together within a relatively constricted space in the interior of the device. When multiple different electrical components are positioned together within a relatively constricted space in the interior of the device in this fashion, and maintenance is performed on an electrical component that, viewed from the back face side of the device chassis, is positioned further inside, there are instances in which the electrical component further inside cannot be accessed unless all of the electrical components positioned to the front side from the electrical component situated further inside are detached one at a time.

For this reason, in some devices, multiple different electrical components are constituted as a unit, making it possible for the multiple different electrical components to be detached as a single unit. In so doing, all of the multiple different electrical components can be detached in a single detachment procedure, whereby even in the event that maintenance of an electrical component situated further inside is necessary, the need for multiple detachment procedures is obviated.

According to the aforedescribed configuration, all of multiple different electrical components can be detached in a single detachment procedure, but since the detachment procedure involves an operation to release screws or the like, from the view of the maintenance person, the procedure is tedious, and ease of operation cannot be considered as satisfactory. Additionally, in the event that multiple different electrical components are detached for maintenance, it is necessary to ensure that there is space to temporarily store the electrical components. Assuming that sufficient space is not available near the image forming device, it will be necessary to store the electrical components at a location away from the image forming device, resulting in even worse ease of operation.

SUMMARY OF THE INVENTION

The image forming device according to a first aspect of the present disclosure is provided with a first electrical component, a second electrical component, a third electrical component, and support members. The first electrical component and the second electrical component are positioned at the back face side of the device chassis, and arranged in positions offset to avoid mutual overlap in the front-back direction of the device chassis. The third electrical component is positioned at the back face side of the device chassis, has pivots positioned at one end in an up-down direction or at one end in a left-right direction, and is swivelable about the pivots as pivot points. The support members pivotably support the pivots. The support members pivotably support the pivots between the first electrical component and the second electrical component. The third electrical component, through swiveling about the pivots as pivot points, is selectively positioned at a first location overlapping the first electrical component in the front-back direction but not overlapping the second electrical component in the front-back direction, or at a second location overlapping the second electrical component in the front-back direction but not overlapping the first electrical component in the front-back direction.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS (Overall Configuration of Image Forming Device)

First, the overall configuration of an image forming device 100 according to the embodiment of the present disclosure will be described, making reference to FIG. 1. This image forming device 100 is a multifunction device able to execute multiple different types of jobs, such as a print job, a copy job, and the like.

Figure 1:
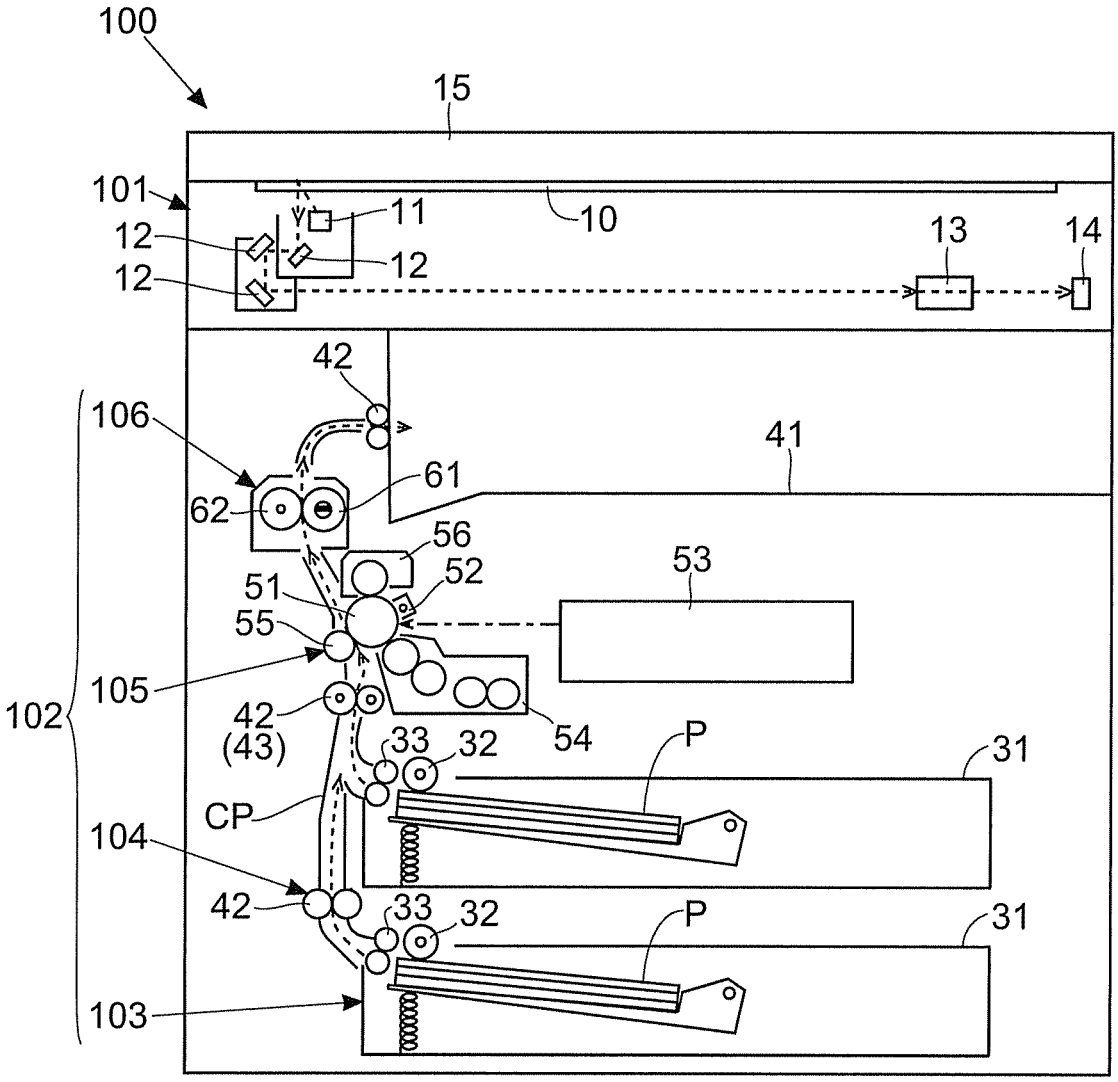
FIG. 1 is a schematic diagram of an image forming device according to an embodiment of the present disclosure.

As shown in FIG. 1, the image forming device 100 of the present embodiment is provided with an image scanning section 101 and an engine section 102 (a paper supply section 103, a paper feed section 104, an image forming section 105, and a fixing section 106).

The image scanning section 101 scans a document and generates image data of the document. This image scanning section 101 includes a lamp 11, a mirror 12, a lens 13, and an image sensor 14. The image scanning section 101 uses the lamp 11 to illuminate a document positioned on contact glass 10, and performs A/D conversion of output values from the image sensor 14 which receives reflected light from the document, thereby generating image data of the document. The image scanning section 101 is additionally furnished with a document holder 15 for pressing down on the document positioned on the contact glass 10.

The paper supply section 103 supplies paper P held in a paper cassette 31 onto a paper feed path CP. This paper supply section 103 includes a pickup roller 32 and a paper supply roller pair 33. The pickup roller 32 sends the paper P held in the paper cassette 31 to a paper supply nip constituted by the paper supply roller pair 33, whereupon the paper supply roller pair 33 supplies the paper P which has advanced into the paper supply nip, onto the paper feed path CP.

The paper P supplied onto the paper feed path CP is fed by paper feed section 104 in sequential fashion to a transfer nip and a fixing nip, and is then discharged into a discharge tray 41. This paper feed section 104 includes a plurality of feed roller pairs 42 for feeding the paper P along the paper feed path CP. One of the feed roller pairs 42 among the plurality of feed roller pairs 42 constitutes a resist roller pair 43. The resist roller pair 43 idles the paper P short of the transfer nip, then delivers the paper P to the transfer nip in synchronized fashion to the timing of formation of a toner image by the image forming section 105.

The image forming section 105 forms a toner image on the basis of image data (image data of a document obtained through scanning by the image scanning section 101, or the like), and transfers the toner image to the paper P. The image forming section 105 includes a photosensitive drum 51, an charging device 52, an exposure device 53, a developing device 54, a transfer roller 55, and a cleaning device 56.

During image formation, the photosensitive drum 51 rotates, and the surface of the photosensitive drum 51 is electrostatically charged to a prescribed potential by the charging device 52. The exposure device 53 performs scanned exposure of the surface of the photosensitive drum 51, forming an electrostatic latent image on the surface of the photosensitive drum 51. The developing device 54 develops the image by supplying toner to the electrostatic latent image formed on the surface of the photosensitive drum 51.

The transfer roller 55 presses against the surface of the photosensitive drum 51, forming a transfer nip in conjunction with the photosensitive drum 51. In this state, the resist roller pair 43, while gauging the timing, advances the paper P into the transfer nip. In so doing, the toner image on the surface of the photosensitive drum 51 is transferred to the paper P. Once transfer of the toner image to the paper P is completed, the cleaning device 56 removes any remaining toner and the like from the surface of the photosensitive drum 51.

The fixing section 106 applies heat and pressure to fix the toner image transferred to the paper P. This fixing section 106 includes a heated roller 61 and a pressure roller 62. The heated roller 61 incorporates a heat source. The pressure roller 62 is pressed against the heated roller 61, forming a fixing nip in conjunction with the heating roller 61. The paper P to which the toner image has been transferred is then subjected to heat and pressure by being passed through the fixing nip. In so doing, the toner image is fixed onto the paper P, completing printing.

(Locations for Positioning of Electrical Components)

Figure 2:
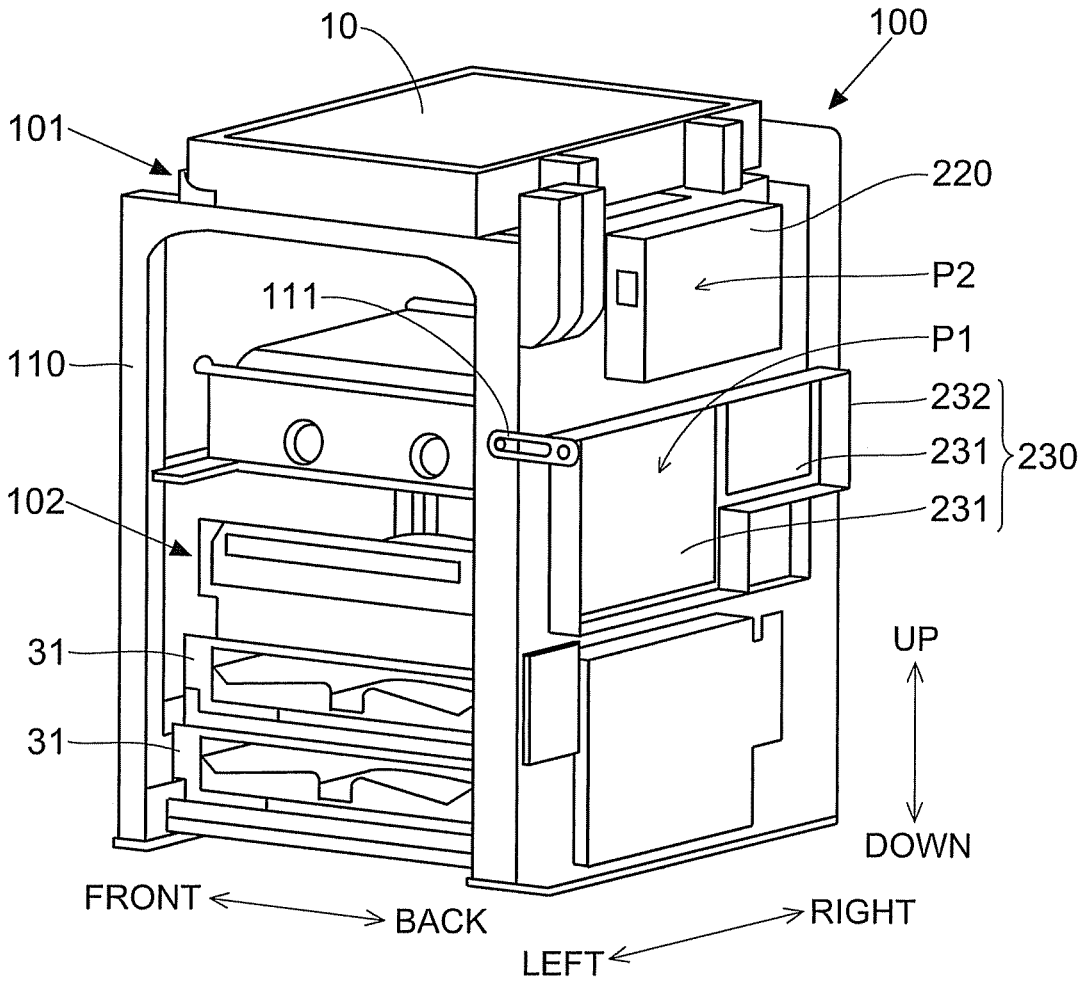
FIG. 2 is a perspective view showing locations for positioning of first to third electrical components positioned at the back face side of the image forming device according to an embodiment of the present disclosure (a view with the third electrical component positioned at the first location)
Figure 3:
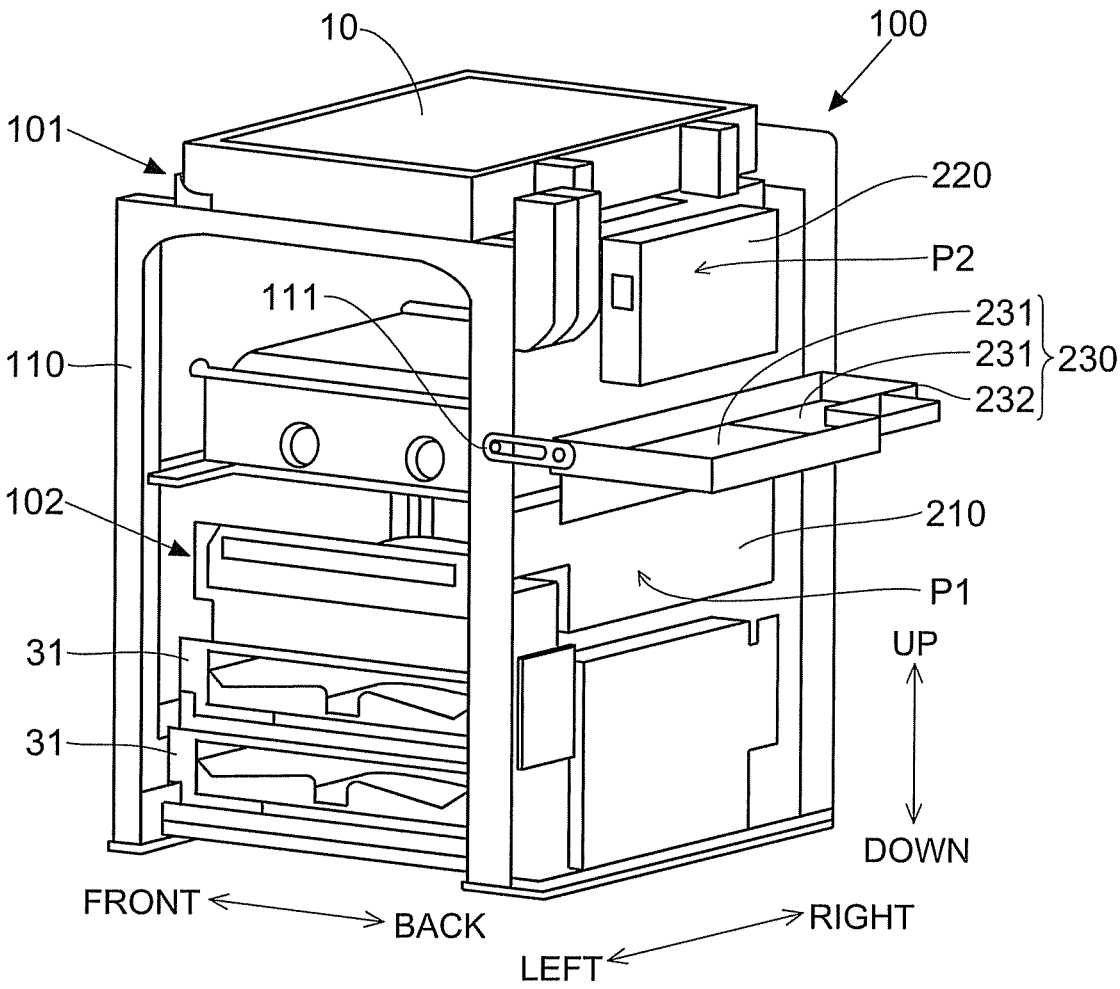
FIG. 3 is a view with the third electrical component shown in FIG. 2 swiveled from the first location to the second location.
Figure 4:
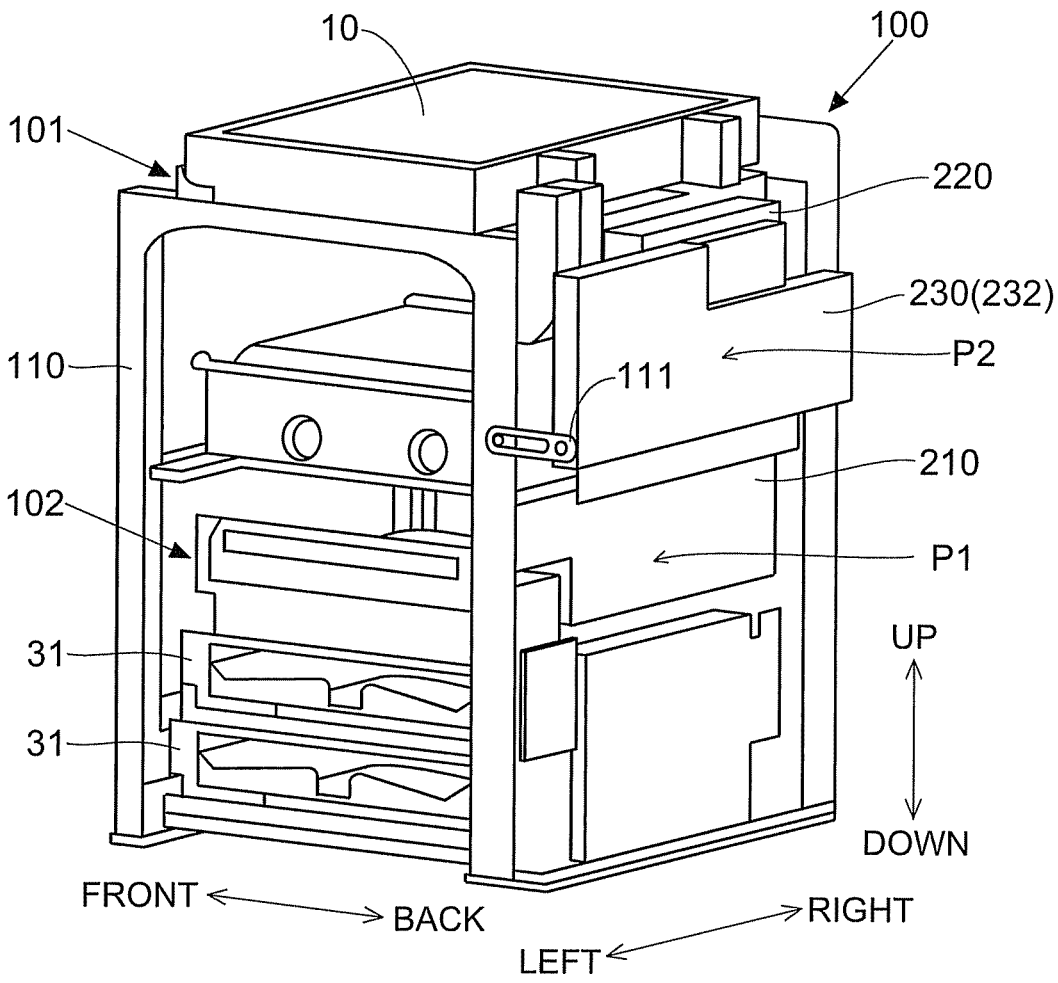
FIG. 4 is a view with the third electrical component shown in FIG. 3 positioned at the second location.

Next, the locations at which are positioned electrical components 210, 220, and 230 installed in the image forming device 100 will be described, making reference to FIGS. 2 to 4. In FIGS. 2 to 4, the image forming device 100 is illustrated with the exterior covers (front face cover, side face covers, back face cover, and the like) removed.

As shown in FIGS. 2 to 4, the electrical components 210, 220, and 230 are positioned at the back face side of the device chassis. For example, the electrical components 210 and 220 may be constituted by an electronic circuit board and a drive unit (a unit including a motor, gears, and the like). The electrical component 230 is an electrical box 232 for housing electronic circuit boards 231 (a main control board and an engine control board) or the like. The electronic circuit boards 231 control the driving of sections of the image forming device 100. The electrical box 232 is made of metal, and has an opening through which the electronic circuit boards 231 are exposed.

The electrical component 210 corresponds to the "first electrical component" of the present disclosure, the electrical component 220 corresponds to the "second electrical component" of the present disclosure, and the electrical component 230 corresponds to the "third electrical component" of the present disclosure. The electronic circuit boards 231 correspond to the "electronic parts" of the present disclosure, and the electrical box 232 corresponds to the "enclosure" of the present disclosure. In the following description, the components are distinguished by designating the electrical component 210 as the first electrical component 210, designating the electrical component 220 as the second electrical component 220, and designating the electrical component 230 as the third electrical component 230.

The image forming device 100 is additionally furnished with a chassis frame 110 made of metal, constituting the skeleton of the device chassis. This chassis frame 110 is a combination of metal panels and metal beams. The first electrical component 210, the second electrical component 220, and the third electrical component 230 are then attached either directly or indirectly to the chassis frame 110.

Here, the image forming device 100 is covered by exterior covers (not illustrated) including a front face cover positioned at the front face side of the device chassis, side face covers cover positioned at side face sides of the device chassis, and a back face cover positioned at the back face side of the device chassis. Maintenance of the first electrical component 210, the second electrical component 220, and the third electrical component 230 is performed, for example, from the rear of the device chassis, with the back face cover removed.

In this case, when the back face cover has been removed, ease of maintenance operations will be improved as long as the first electrical component 210, the second electrical component 220, and the third electrical component 230 are all exposed. That is, in order to improve the ease of maintenance operations, the locations at which the first electrical component 210, the second electrical component 220, and the third electrical component 230 are positioned should be established such that there is no mutual overlap among any of the electrical components. However, when the locations for positioning the electrical components are established in this manner, the size in the left-right direction (or the size in the front-back direction) must be greater, and therefore the image forming device 100 becomes larger in size. The left-right direction refers a direction orthogonal to the up-down direction when the device chassis is viewed from the back face side.

To address this issue, in the present embodiment, the locations at which first electrical component 210 and the second electrical component 220 are positioned are offset in the up-down direction such that there is no mutual overlap in the front-back direction. As one example, the location at which the first electrical component 210 is positioned may be established below the location at which the second electrical component 220 is positioned. The third electrical component 230 may then be positioned so as to overlap the first electrical component 210 or the second electrical component 220 in the front-back direction. However, when for example the third electrical component 230 is positioned overlapping the first electrical component 210 in the front-back direction, and under these conditions the third electrical component 230 is fastened to the chassis frame with screws or the like, the third electrical component 230 must be detached during maintenance of the first electrical component 210, and the ease of maintenance operations is diminished.

Accordingly, the third electrical component 230 is designed to allow selective positioning thereof at a first location P1 overlapping the first electrical component 210 in the front-back direction, and at a second location P2 overlapping the second electrical component 220 in the front-back direction. When the third electrical component 230 is at the first location P1 (see FIG. 2), as seen from the back face side of the device chassis, the first electrical component 210 is covered by the third electrical component 230, while the second electrical component 220 is exposed. On the other hand, when the third electrical component 230 is at the second location P2 (see FIG. 4), the second electrical component 220 is covered by the third electrical component 230, while the first electrical component 210 is exposed.

In so doing, when the third electrical component 230 is positioned at the first location P1, maintenance of the second electrical component 220 can be performed, and when the third electrical component 230 is positioned at the second location P2, maintenance of the first electrical component 210 can be performed. Additionally, when the third electrical component 230 is positioned at the first location P1, the opening of the electrical box 232 thereof faces to the rear of the device chassis, making it possible to access the electronic circuit boards 231 through the opening of the electrical box 232. Consequently, maintenance of the third electrical component 230 will be performed with the third electrical component 230 positioned at the first location P1. For example, the first location P1 may be the default location for positioning the third electrical component 230. A design whereby, when the third electrical component 230 is positioned at the second location P2, the opening of the electrical box 232 faces to the rear of the device chassis would also be acceptable.

In the present embodiment, to permit selective positioning of the third electrical component 230 at the first position P1 or the second position P2, the third electrical component 230 is attached in vertically swiveling fashion to the chassis frame 110. That is, when the third electrical component 230 positioned at the first location P1 is swiveled upward, the location at which the third electrical component 230 is positioned is displaced in the order shown in FIGS. 2, 3, and 4, until finally the third electrical component 230 is positioned at the second location P2.

(Swivel Structure of Third Electrical Component)

Next, the swivel structure of the third electrical component 230 will be described, making reference to FIGS. 5 to 9.

Figure 5:
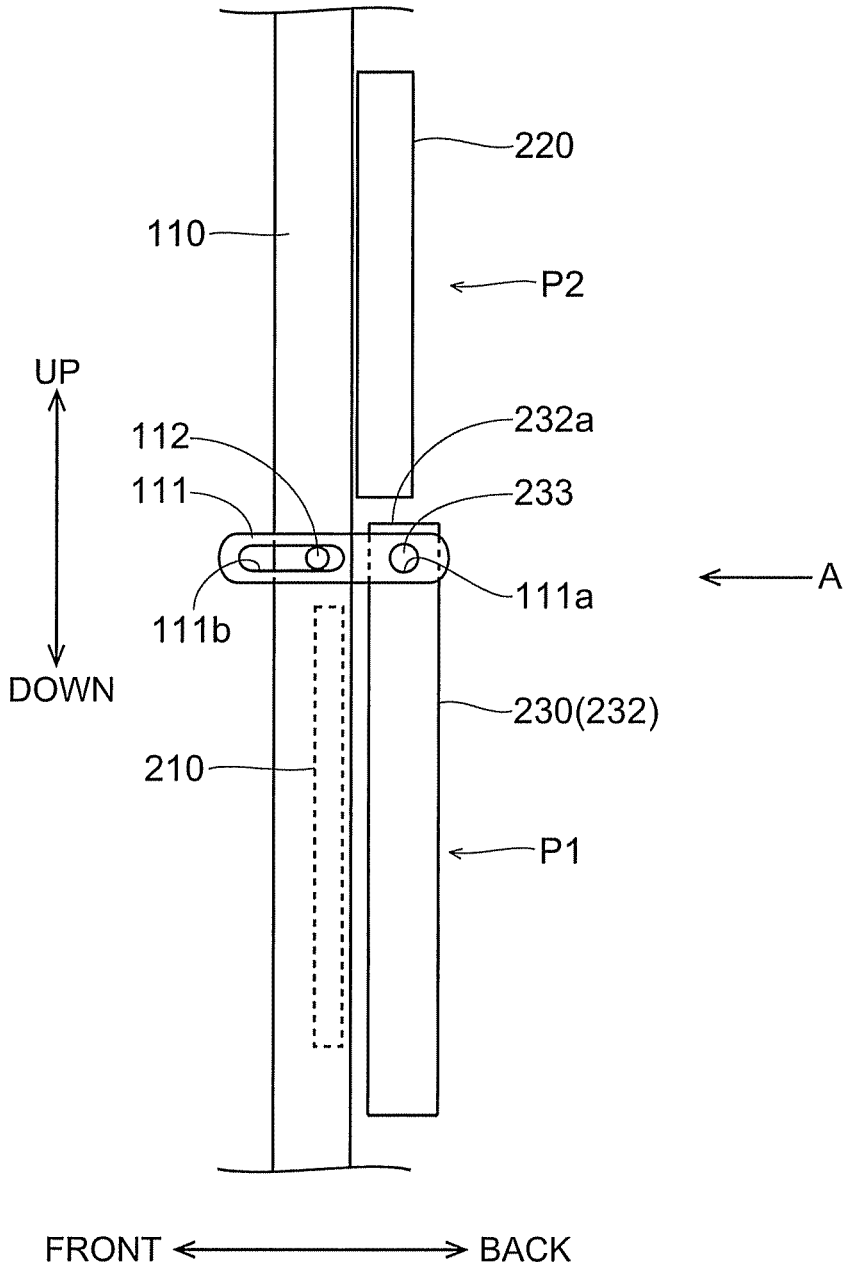
FIG. 5 is a schematic diagram showing positions at which are positioned the first to third electrical components positioned at the back face side of the image forming device according to the embodiment of the present disclosure (a view with the third electrical component positioned at the first location, in a state in which the support members have not been slid towards the rear of the device chassis)
Figure 6:
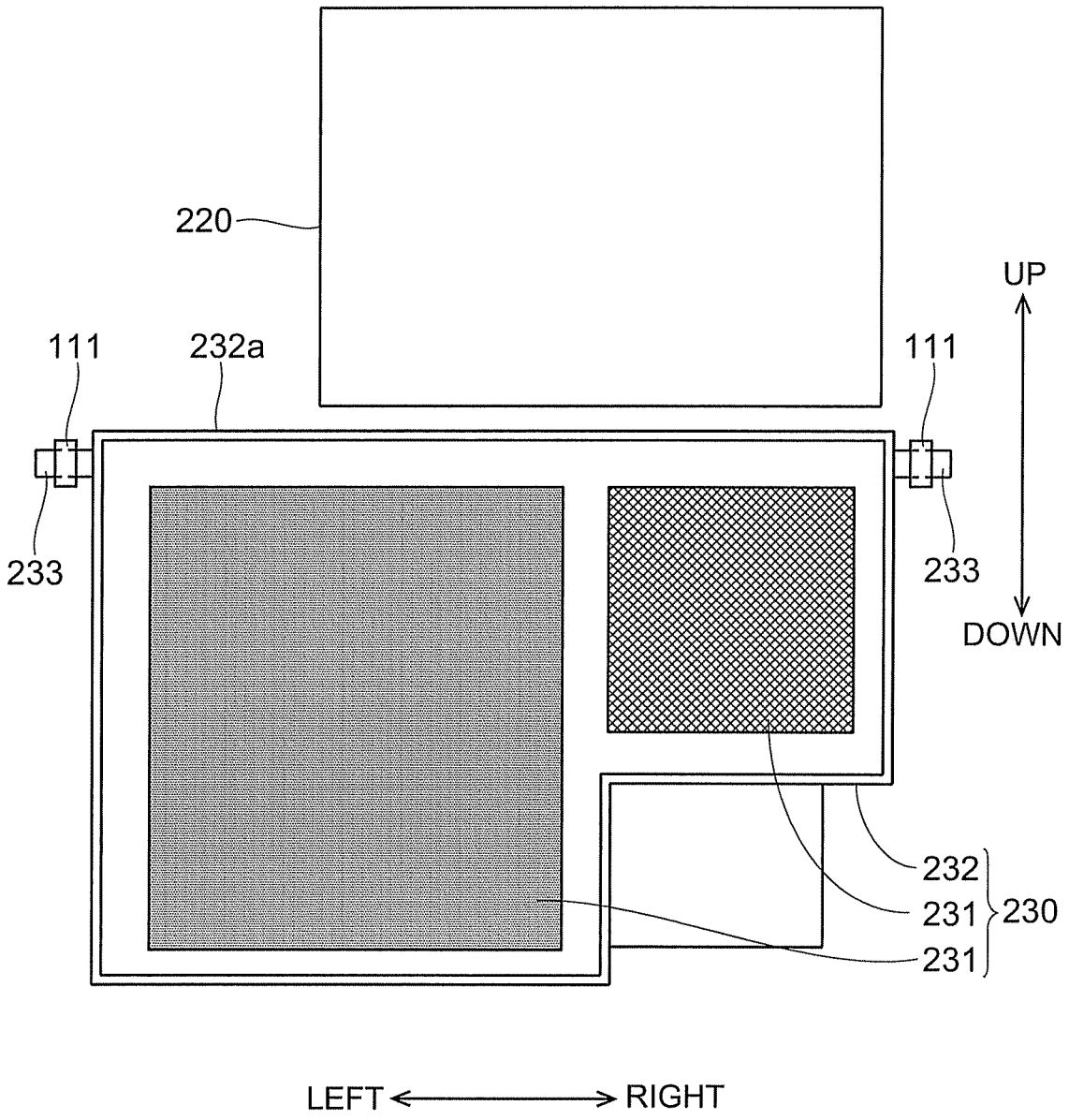
FIG. 6 is a view taken in the direction of arrow A in FIG. 5.

As shown in FIGS. 5 and 6, the third electrical component 230 has pivots 233 furnished to the electrical box 232 at one end 232*a* thereof in the up-down direction (the upper end side of the electrical box 232 with the third electrical component 230 positioned at the first location P1). The pivots 233 are constituted by cylindrical pins, the axial direction of which is the left-right direction, with one being positioned at each of a pair of box side faces in the left-right direction of the electrical box 232. The pivots 233 protrude to the outside from the side faces of the box.

To the chassis frame 110 are attached a pair of left and right brackets 111 (corresponding to the "support members" of the present disclosure) for pivotably supporting the pivots 233. The brackets 111 protrude towards the rear of the device chassis from the chassis frame 100, and have a mating aperture 111*a* passing through the protruding distal end in the left-right direction. The pivots 233 fit within the mating apertures 111*a* of the bracket 111, whereby the third electrical component 230 is swivelable in the up-down direction about the pivots 233 as the pivot points of swivel.

The brackets 111 are slidable in the front-back direction. For example, a guide aperture 111*b* composed of a slot having a long axis aligned in the front-back direction is formed in each of the brackets 111. The chassis frame 110 is furnished with guide pins 112 for insertion into the guide apertures 111*b* of the brackets 111. The guide pin 112 contacts the inside peripheral surface of the guide aperture 111*b* of the bracket 111, and guides the bracket 111 to slide in the front-back direction. By sliding the brackets 111 towards the rear of the device chassis, the pivotal support locations of the pivots 233 are shifted rearward (from the state shown in FIG. 5 to the state shown in FIG. 7). For example, when the third electrical component 230 is swiveled in the up-down direction, as the pivotal support locations of the pivots 233 shift rearward, an end 232*a* of the electrical box 232 lying towards the pivot 233 side does not come into contact with the other electrical components (the first electrical component 210 and the second electrical component 220) which are situated to the back face side of the device chassis. The state shown in FIG. 7 corresponds to the state shown in FIG. 2.

Figure 7:
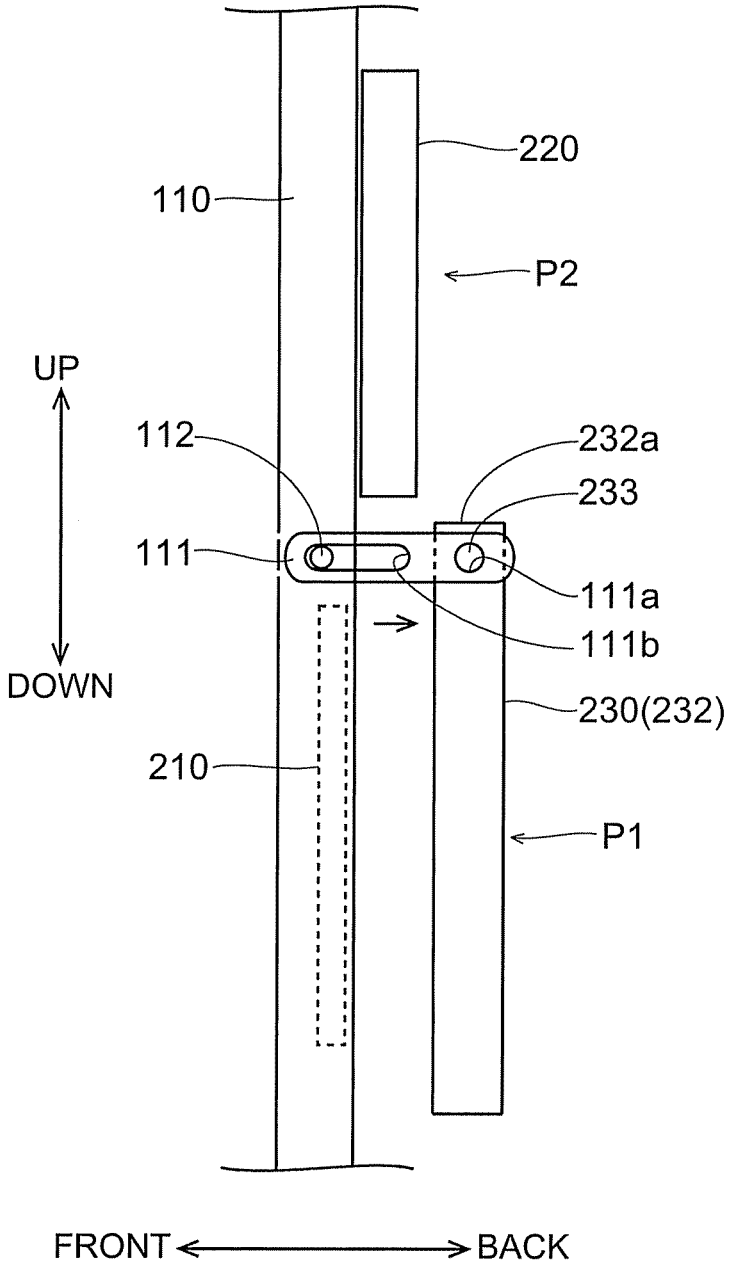
FIG. 7 is a view with the support members shown in FIG. 5 slid towards the rear of the device chassis.

Here, the installation locations of the brackets 111 in the up-down direction are established between the first electrical component 210 and the second electrical component 220. That is, the brackets 111 pivotably support the pivots 233 between the first electrical component 210 and the second electrical component 220. For this reason, when force swiveling the third electrical component 230 upward is not applied to the third electrical component 230, the third electrical component 230 is held at the first location P1 by the weight of the third electrical component 230 itself, as shown in FIGS. 5 and 7. At this time, as seen from the back face of the device chassis, the first electrical component 210 is covered by the third electrical component 230, while the second electrical component 220 is exposed.

Figure 8:
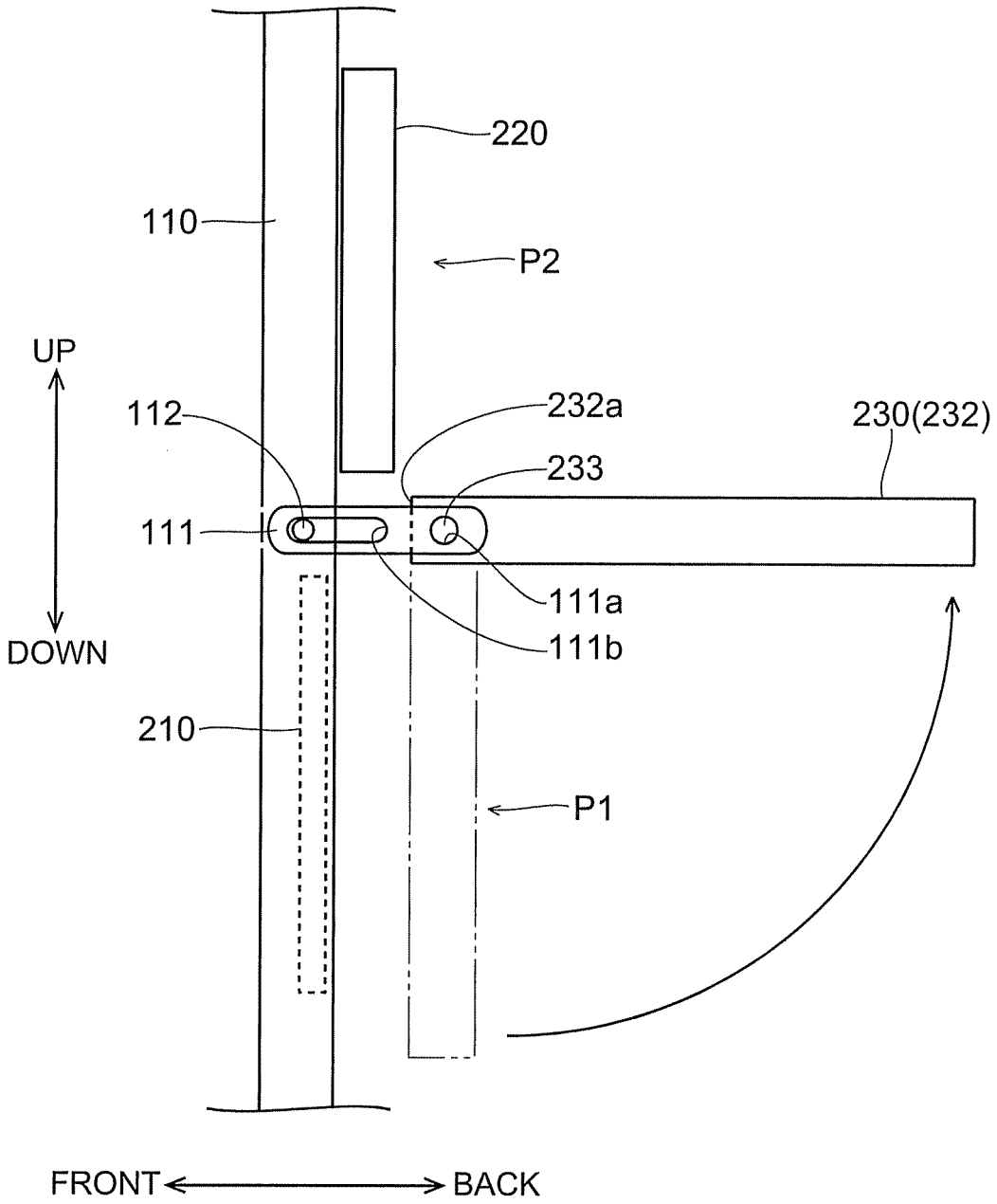
FIG. 8 is a view with the third electrical component shown in FIG. 7 swiveled from the first location towards the second location.
Figure 9:
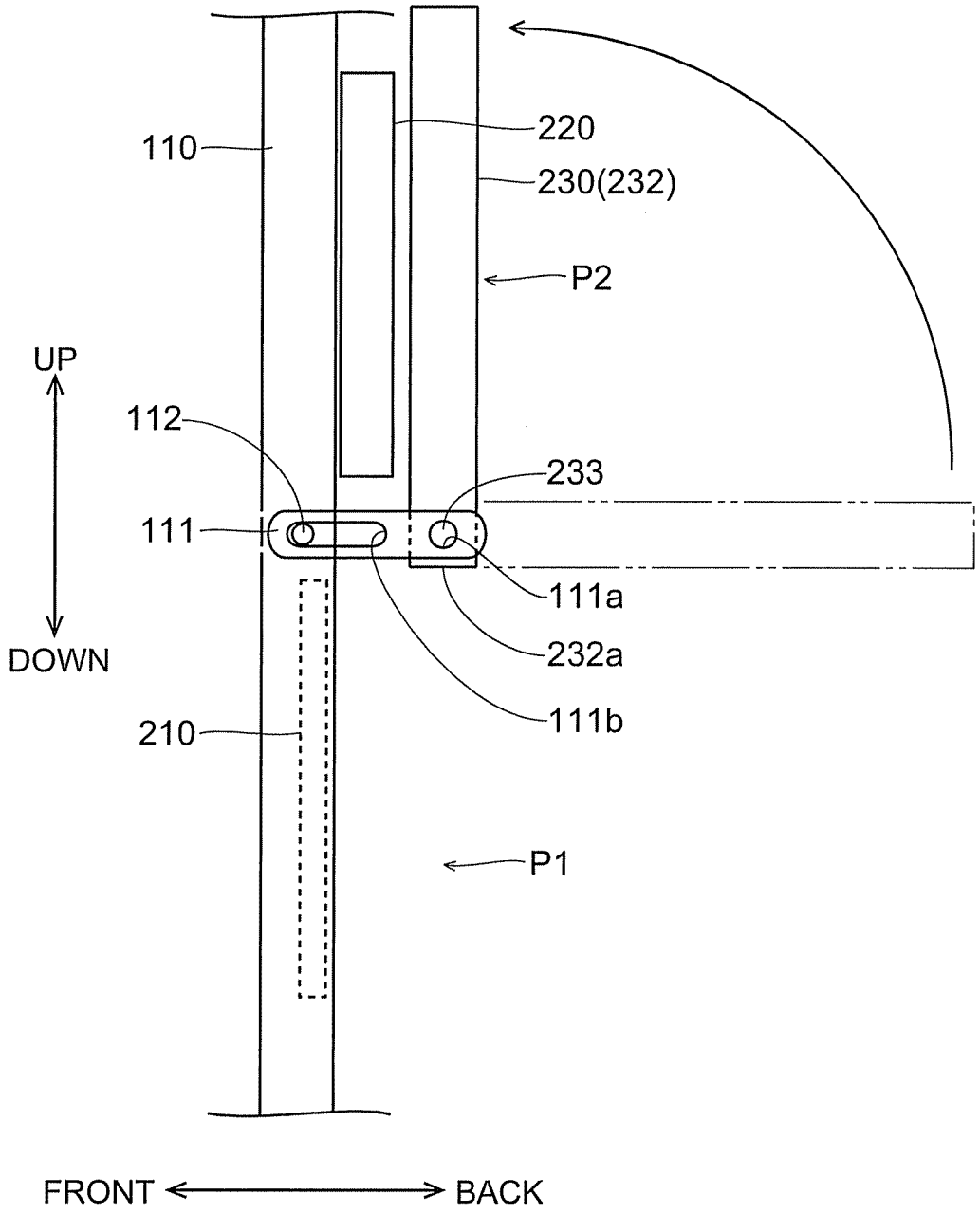
FIG. 9 is a view with the third electrical component shown in FIG. 8 positioned at the second location.

As shown in FIG. 8, when force swiveling the third electrical component 230 upward is applied to the third electrical component 230, the third electrical component 230 swivels upward about the pivots 233 as the pivot points of swivel. Then, as the third electrical component 230 continues to swivel upward, the third electrical component 230 is ultimately situated at the second location P2, as shown in FIG. 9. In so doing, as seen from the back face side of the device chassis, the first electrical component 210 is exposed, while the second electrical component 220 is covered by the third electrical component 230. For example, holding mechanisms (engaging parts such as hooks or the like) for holding the third electrical component 230 at the second location P2 may be furnished respectively to the electrical box 232 and the chassis frame 110, so that the third electrical component 230 does not swivel downward under its own weight. The state shown in FIG. 8 corresponds to the state shown in FIG. 3, and the state shown in FIG. 9 corresponds to the state shown in FIG. 4.

(Lead-Out Sites of Electrical Wires Wired to Third Electrical Component)

Next, the lead-out sites of electrical wires 234 wired to the third electrical component 230 will be described, making reference to FIG. 10.

Figure 10:
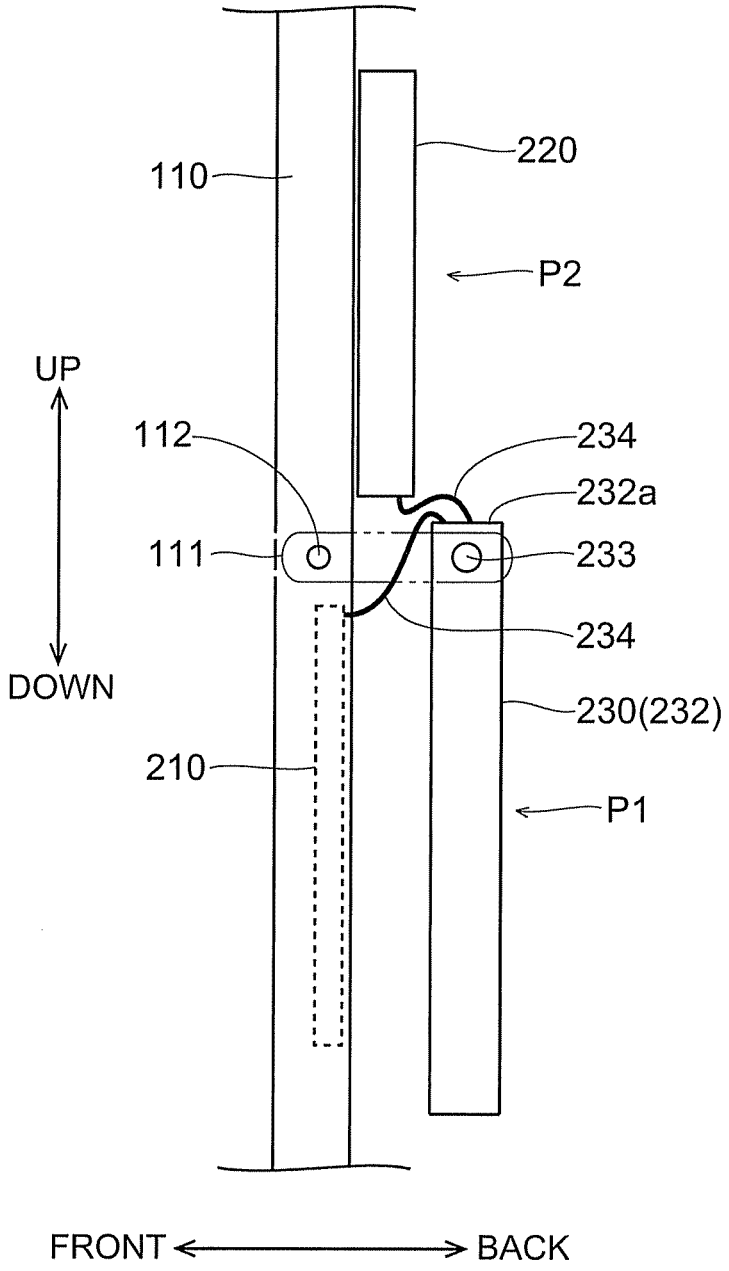
FIG. 10 is a schematic diagram showing lead-out sites of electrical wires leading out from the third electrical component positioned at the back face side of the image forming device according to the embodiment of the present disclosure.

As shown in FIG. 10, the electrical wires 234, which connect to the electronic circuit boards 231, are wired to the third electrical component 230. The electrical wires 234 are led out from the electrical box 232, and connect to the first electrical component 210'and the second electrical component 220 or the like. Here, in a case in which the electrical wires 234 are led out from the electrical box 232 at the end thereof on the opposite side from the pivot 233 side (i.e., the lower end of the electrical box 232 when the third electrical component 230 is at the first position P1), it would be necessary to impart considerable slack to the electrical wires 234 leading out from the electrical box 232 (the electrical wires 234 must be long), so as to prevent the electrical wires 234 from being stretched by the third electrical component 230 when the third electrical component 230 swivels. However, in doing so, slack portions of the electrical wires 234 may become caught, impeding swivel of the third electrical component 230, and posing a risk of disconnecting the electrical wires 234 themselves. A further risk is that the electrical wires 234 will be pinched or entangled by the third electrical component 230 as it swivels.

For this reason, according to the present embodiment, the electrical wires 234 are led out from the electrical box 232 at the end 232*a* thereof on the pivot 233 side (the upper end of the electrical box 232 when the third electrical component 230 is at the first position P1). Here, when the third electrical component 230 is swiveled, the location of the end 232*a* of the electrical box 232 on the pivot 233 side experiences substantially no displacement. Consequently, by having the electrical wires 234 lead out from the electrical box 232 at the end 232*a* thereof on the pivot 233 side, there is no need to impart considerable slack to the electrical wires 234 leading out from the electrical box 232 (the electrical wires 234 need not be long).

As described above, the image forming device 100 of the present embodiment has: the first electrical component 210 and the second electrical component 220 which are situated at the back face side of the device chassis, at positioning locations at which are offset in the up-down direction to avoid mutual overlap in the front-back direction of the device chassis; the third electrical component 230 which is positioned at the back face side of the device chassis, which has pivots 233 positioned at the one end 232*a* in the up-down direction, and which is swivelable in the up-down direction about the pivots 233 as pivot points; and the brackets 111 (support members) which pivotably support the pivots 233. The brackets 111 pivotably support the pivots 233 between the first electrical component 210 and the second electrical component 220; and the third electrical component 230, through swiveling in the up-down direction about the pivots 233 as pivot points, is selectively positioned at the first location P1 overlapping the first electrical component 210 in the front-back direction but not overlapping the second electrical component 220 in the front-back direction, or at the second location P2 overlapping the second electrical component 220 in the front-back direction but not overlapping the first electrical component 210 in the front-back direction.

According to the configuration of the present embodiment, of the first electrical component 210, the second electrical component 220, and the third electrical component 230 which are positioned at the back face side of the device chassis, the positioning locations of the first electrical component 210 and the second electrical component 220 are offset in the up-down direction, such that there is no mutual overlap in the front-back direction. The third electrical component 230 is then selectively positioned at the first location P1 overlapping the first electrical component 210 in the front-back direction but not overlapping the second electrical component 220 in the front-back direction, or at the second location P2 overlapping the second electrical component 220 in the front-back direction but not overlapping the first electrical component 210 in the front-back direction. In so doing, when the third electrical component 230 is positioned at the first location P1, the second electrical component 220, viewed from the back face side of the device chassis, is exposed, whereby maintenance (including attachment or detachment) of the second electrical component 220 may be performed. When the third electrical component 230 is positioned at the second location P2, the first electrical component 210, when viewed from the back face side of the device chassis, is exposed, whereby maintenance of the first electrical component 210 may be performed.

Here, the third electrical component 230 (the electrical box 232) has the pivots 233 situated at the one end 232*a* in the up-down direction, and swivels in the up-down direction due to the pivots 233 being pivotably supported between the first electrical component 210 and the second electrical component 220 by the brackets 111. That is, through swivel of the third electrical component 230 in the up-down direction, the third electrical component 230 is selectively positioned at the first location P1 or the second location P2. For this reason, maintenance of all of the electrical components is possible, without having to detach the first electrical component 210, the second electrical component 220, or the third electrical component 230. Because there is no need to detach the first electrical component 210, the second electrical component 220, or the third electrical component 230, there is no need to ensure space for temporary storage of the detached electrical components. As a result, the ease of maintenance operations is improved.

Further, according to the configuration of the present embodiment, when the third electrical component 230 is positioned at the first location P1, the third electrical component 230 overlaps the first electrical component 210 in the front-back direction, and when the third electrical component 230 is positioned at the second location P2, the third electrical component 230 overlaps the second electrical component 220 in the front-back direction. That is, when the third electrical component 230 is positioned at the first location P1 or the second location P2, the end of the third electrical component 230 at the opposite side thereof from the pivots 233 does not protrude to the rear of the device chassis. In so doing, the space at the rear of the device chassis (the space for operations by a maintenance operator) can be larger, and maintenance may be easily performed from the rear of the device chassis.

Further, as described above, according to the present embodiment, the brackets 111 are slidable in the front-back direction. The pivot-support positions of the pivots 233 are shifted towards the rear of the device chassis (the end 232*a* of the electrical box 232 at the pivot 233 side is shifted towards the rear of the device chassis) through sliding of the brackets 111 towards the rear of the device chassis. According to this configuration, a situation in which the end 232*a* of the electrical box 232 at the pivot 233 side strikes against the other electrical components positioned at the back face side of the device chassis when the third electrical component 230 is swiveled in the up-down direction can be avoided. That is, the third electrical component 230 can easily swivel in the up-down direction.

Moreover, as described above, according to the present embodiment, the electrical wires 234 are wired to the third electrical component 230. The electrical wires 234 are led out from the electrical box 232 at the side 232*a* thereof where the pivots 233 are located. According to this configuration, even when considerable slack is not imparted to the electrical wires 234 leading out from the electrical box 232 (even when the electrical wires 234 are not long), the third electrical component 230 will not stretch the electrical wires 234 when the third electrical component 230 is swiveled in the up-down direction.

Moreover, as described above, according to the present embodiment, the third electrical component 230 includes the electrical box 232 (enclosure) for housing the electronic circuit boards 231 (electrical components). The pivots 233 are then furnished to the electrical box 232. According to this configuration, the pivots 233 can be easily furnished to the third electrical component 230, which is intended to be swivelable in the up-down direction.

The embodiments disclosed herein are in all respects merely exemplary, and should not be construed as limiting. The scope of the present disclosure is shown by the claims and not by the foregoing description of the embodiments, and all modifications equivalent in significance within the scope of the claims are encompassed therein.

Figure 11:
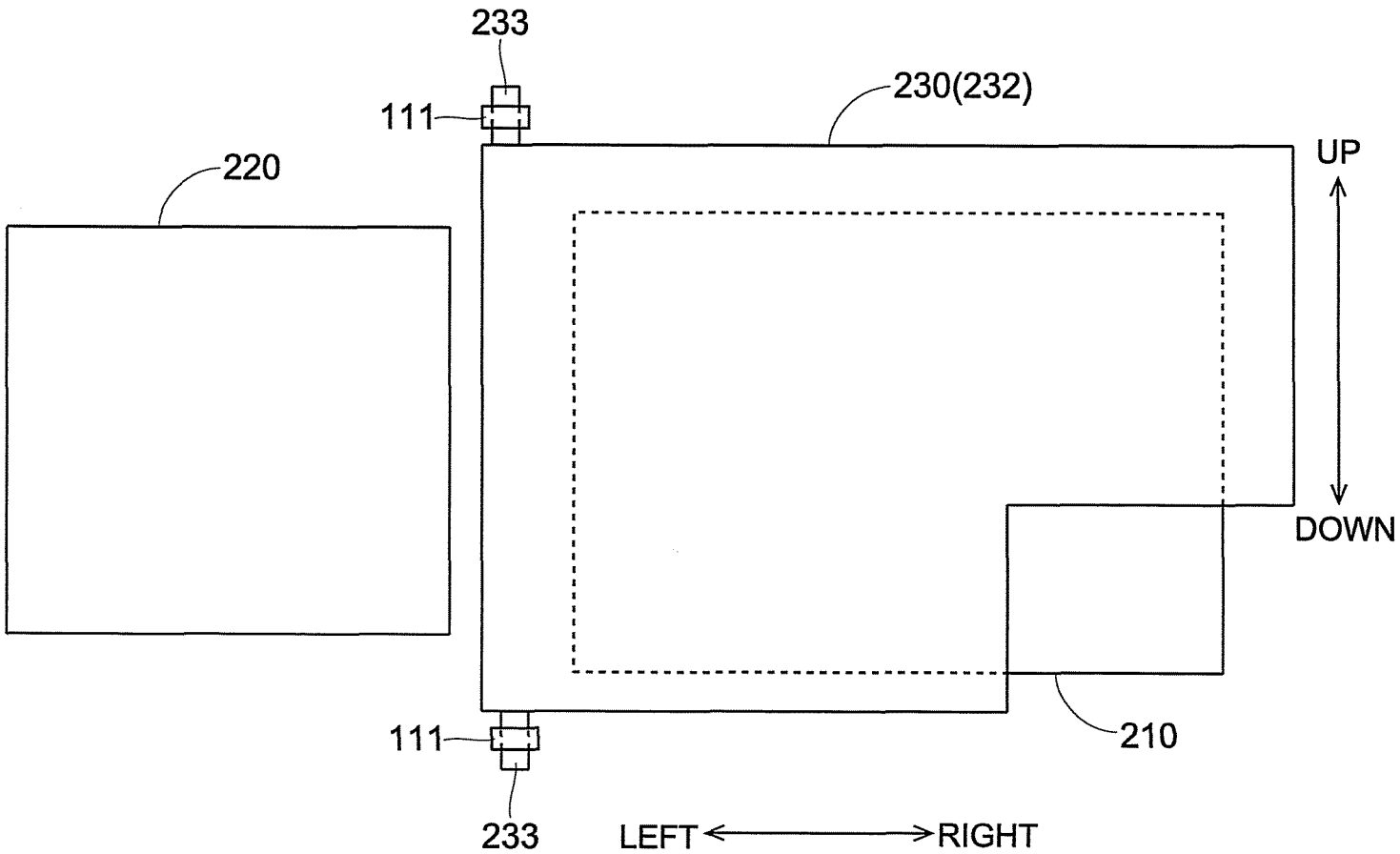
FIG. 11 is a view showing positions at which are positioned the first to third electrical components according to a modification example of the embodiment of the present disclosure.

For example, in the aforedescribed embodiment, the first electrical component 210 and the second electrical component 220 are positioned offset in the up-down direction, with the third electrical component 230 being swivelable in the up-down direction. However, it would be acceptable that the first electrical component 210 and the second electrical component 220 at an offset in the left-right direction, with the third electrical component 230 being swivelable in the left-right direction, as shown in FIG. 11. In this case, the pivots 233 would be furnished at one end of the third electrical component 230 (the electrical box 232) in the left-right direction. The brackets 111 would then be positioned between the first electrical component 210 and the second electrical component 220 situated adjacently in the left-right direction, the pivots 233 being pivotably supported by the brackets 111. In the case of this configuration as well, through swiveling of the third electrical component 230 in the left-right direction about the pivots 233 as the pivot points, the third electrical component 230 can be positioned at a position overlapping the first electrical component 210 in the front-back direction (a position not overlapping the second electrical component 220 in the front-back direction), or the third electrical component 230 can be positioned at a position overlapping the second electrical component 220 in the front-back direction (a position not overlapping the first electrical component 210 in the front-back direction).

What is claimed is:

1. An image forming device, comprising:

a first electrical component and a second electrical component situated at the back face side of a device chassis, and arranged in positions offset such that there is no mutual overlap in the front-back direction of the device chassis;

a third electrical component positioned at the back face side of the device chassis, the third electrical component having pivots positioned at one end in an up-down direction, and being swivelably supported about the pivots as pivot points; and support members for pivotably supporting the pivots, wherein:

the support members pivotably supports the pivots between the first electrical component and the second electrical component;

the third electrical component, through swiveling about the pivots as pivot points, is selectively positioned at a first location overlapping the first electrical component in the front-back direction but not overlapping the second electrical component in the front-back direction, or at a second location overlapping the second electrical component in the front-back direction but not overlapping the first electrical component in the front-back direction;

a location at which the first electrical component is positioned is established below a location at which the second electrical component is positioned in the up-down direction;

the first location where the third electrical component overlaps the first electrical component in the front-back direction is a default location for positioning the third electrical component;

when the third electrical component is positioned at the first location, the third electrical component is held at the first location by weight of the third electrical component itself;

the support members are slidable in the front-back direction with the third electrical component positioned at the first location; and by sliding the support members towards a rear of the device chassis with the third electrical component positioned at the first location, pivot-support positions of the pivots are shifted towards the rear of the device chassis, and by swiveling the third electrical component upwards in the up-down direction about the pivots as pivot points with the pivot-support positions of the pivots shifted towards the rear of the device chassis, the third electrical component is positioned at the second location.

2. The image forming device according to claim 1, further comprising a chassis frame constituting the skeleton of the device chassis, wherein the support members have a guide aperture comprising a slot having a long axis aligned in the front-back direction, the frame is furnished with guide pins for insertion into the guide apertures, and the support members are supported slidably in the front-back direction through insertion of the guide pins into the guide apertures.

3. The image forming device according to claim 1, wherein electrical wires are wired to the third electrical component, and the wires are led out from an end on the pivot side of the third electrical component.

4. The image forming device according to claim 1, wherein the third electrical component includes an enclosure for housing electronic components, and the pivots are furnished to the enclosure.

5. The image forming device according to claim 4, wherein the enclosure has an opening for exposing the electronic components, and the opening of the enclosure faces to the rear of the device chassis when the third electrical component is positioned at the first location or at the second location.

6. The image forming device according to claim 4, further comprising a chassis frame constituting a skeleton of the device chassis, wherein the enclosure and the chassis frame are each furnished with a holding mechanism for holding the third electrical component at the second location.

* * * * *